United States Patent [19]

James

[11] 4,441,046

[45] Apr. 3, 1984

[54] INCANDESCENT LAMPS WITH NEODYMIUM OXIDE VITREOUS COATINGS

[75] Inventor: William G. James, Cleveland Heights, Ohio

[73] Assignee: General Electric Company, Schenectady, N.Y.

[21] Appl. No.: 334,803

[22] Filed: Dec. 28, 1981

[51] Int. Cl.[3] ..... H01J 5/16; H01J 61/40; H01K 1/26; H01K 1/30

[52] U.S. Cl. ..... 313/112; 313/116

[58] Field of Search ..... 313/112, 116

[56] References Cited

U.S. PATENT DOCUMENTS 4,081,709 3/1978 Collins et al. ..... 313/116
4,099,080 7/1978 Dawson et al. ..... 313/116
4,315,186 2/1982 Hirano et al. ..... 313/112 X
4,395,653 7/1983 Graff ..... 313/112

*Primary Examiner*—David K. Moore
*Assistant Examiner*—K. Wieder
*Attorney, Agent, or Firm*—John F. McDevitt; Philip L. Schlamp; Fred Jacob

[57] ABSTRACT

A silica powder mixture containing a glass frit having neodymium oxide dispersed therein is disclosed for electrostatic deposition to provide diffuse light from an incandescent lamp which improves the aesthetic appearance of objects illuminated by the lamp emission. Specifically, said coating selectively absorbs green and yellow color radiation being given off by the incandescent lamp filament rendering objects illuminated by the remaining light to appear more pink in color.

6 Claims, 3 Drawing Figures

INCANDESCENT LAMPS WITH NEODYMIUM OXIDE VITREOUS COATINGS

RELATED APPLICATIONS

In a co-pending U.S. Patent Application Ser. No. 276,976, filed June 24, 1981, now U.S. Pat. No. 4,395,653 issued July 26, 1983, and assigned to the assignee of the present invention, there is described a vitreous frit in the form of zinc borosilicate glass containing neodymium oxide which is particularly useful to color the soda lime glass envelope of incandescent lamps. Specifically, a neodymium oxide frit glass composition for use as a fired coating on soda lime glass lamp envelopes comprises in approximate weight percent: 10–20 ZnO, 8–20 $SiO_2$, 15–20 $B_2O_3$, 0–2 $Al_2O_3$, 30–40 $Nd_2O_3$, 1–2 $NaO_2$, 6–8 $K_2O$, 0–5 BaO, 0–5 CaO, 1–3 $ZrO_2$, and 1–3 F except for residual impurities and refining agents. Mixing this frit glass in powder form with a conventional organic suspending liquid provides a slurry suitable for deposition and firing on the soda lime glass envelope surface to produce the desired final glossy transparent coating. A different vitreous frit containing increased neodymium oxide content up to approximately 70% by weight can be electrostatically deposited as a powder mixture with particular silica suspending agents producing a particular particle size range and electrical conductivity characteristics suitable for electrostatic deposition. Both type coatings provide a uniform blue white color lamp emission by selectively absorbing green and yellow color radiation being given off by the light source. A pleasant aesthetic result is thereby provided wherein skin tones and other objects being illuminated by the remaining lamp emission appear more pink in color. The light output of the coated lamps is not reduced more than approximately 15 percent and some of said light diffusion coatings can hide the incandescent filament of the coated incandescent lamps. The present invention constitutes an improvement obtained by a compositional modification of said electrostatically deposited lamp coatings to enhance deposition and reduce moisture sensitivity.

In a more recently filed U.S. Patent Application Ser. No. 328,040, filed Dec. 7, 1981 and also assigned to the present assignee, there is disclosed electrostatic coatings of silica on the inner bulb wall of electric lamps and which also requires controlling the particle size and electrical resistivity of the powder mixture. The deposited coatings are obtained with a powder mixture comprising in parts by weight approximately 35–65 parts flux calcined diatomaceous silica, approximately 35–65 parts fumed silica, and approximately 5–15 parts colloidal hydrophobic silica, said powder having a Coulter particle size between 1 and 6 microns with electrical conductivity in the range from $1\times10^{-4}$ to $2.3\times10^{-7}$ amperes at an applied voltage of 7 kilovolts and $3\times10^{-4}$ to $4\times10^{-9}$ amperes at 2 kilovolts applied voltage. Said powder mixture is less sensitive to ambient moisture conditions both in storage as well as thereafter when applied to incandescent lamps to provide better lumen maintenance and longer life. Colored pigments are contemplated for use in said improved silica coatings with a requirement that the color pigment have suitable electrical conductivity and particle size characteristics. The present invention utilizes powdered mixtures utilizing these same silica constituents in providing a deposited coating with improved performance characteristics.

SUMMARY OF THE INVENTION

It is an important object of the present invention, therefore, to provide a colored light diffusion coating for incandescent lamps which can be electrostatically deposited from a powder mixture reliably in the same manner customarily used and with said powder mixture being less sensitive to ambient moisture problems both in storage as well as when applied to the lamps. A still further important object of the present invention is to provide a uniform blue white color lamp emission attributable to said electrostatically deposited coating which selectively absorbs green and yellow color radiation being produced by the incandescent filament without reducing the light output from said lamp more than approximately 15 percent. The foregoing objects are achieved in accordance with the present invention using an otherwise conventional incandescent lamp having a sealed glass envelope, a pair of lead-in wires hermetically sealed within said envelope, and a resistive filament connected to said lead-in wires, with an electrostatically deposited light diffusion coating on the inner surface of said glass envelope that absorbs light in the green and yellow wavelength region of the spectrum without reducing the light output of said lamp more than approximately 15 percent, said coating comprising in parts by weight approximately 55–65 parts of a vitreous frit containing neodymium oxide dispersed therein, approximately 10–25 parts flux calcined diatomaceous silica, approximately 10–25 parts fumed silica, and approximately 2–10 parts colloidal hydrophobic silica. Useful powder mixtures to provide an electrostatically deposited coating by the general method described more fully in U.S. Pat. No. 4,081,709, further exhibit a Coulter particle size between 1 and 6 microns with electrical conductivity in the range from $1\times10^{-4}$ to $2.3\times10^{-7}$ amperes at an applied voltage of 7 kilovolts and $3\times10^{-4}$ to $4\times10^{-9}$ amperes at 2 kilovolts applied voltage. The diatomaceous silica constituent in the present powder mixture is commercially available as exemplified by the flux calcined grades of said material being sold under the trade name "Dicalite" by the General Refractories Company. For example, the flux calcined "white filler" grade of said Dicalite filler has been found particularly useful in a preferred coating of the present invention and other grades of the same material with the same particle size and bulk density characteristics would be expected to perform comparably so long as the moisture content in the material does not exceed about 1 percent by weight. The useful type fumed silica in the present powder mixture exhibits an electrical resistivity greater than $10^{12}$ ohm-centimeters and also does not have a moisture content exceeding about 1 percent by weight. A commercially available grade of fumed silica is available from Degussa, Inc. being sold under the trade name "Ox-50" which has an ultimate particle size of about 0.05 microns along with a surface area in the range 40–70 square meters per gram, as measured by nitrogen absorption (B.E.T. method). A useful type colloidal hydrophobic silica for use in the present powder mixture is also commercially available and generally obtained by flame hydrolysis with particles varying in diameter between about 0.01 and 0.04 microns. In commercial preparation, silanol groups present on the surface area of the aerosol powder are reacted with dimethyl dichlorosilane to produce a hydrophobic nature for said material. A commercial grade of said product is sold by Degussa, Inc. under the trade name "R972" with a surface area that resides in the approximate range 100–300 square meters per gram (B.E.T. method).

A particular glass frit composition producing selective light absorption in the present lamp coating is described in the aforementioned pending U.S. patent application Ser. No. 276,976, as previously indicated. Accordingly, said glass composition comprises a zinc borosilicate glass containing neodymium oxide in amounts sufficient to produce significant absorption of the light being emitted by the incandescent lamp filament in the green and yellow wavelength region. More particularly, the present glass frit produces two unique absorption doublets attributable to neodymium in the visible region with one doublet occurring at 510 and 530 nanometers wavelength in the green region while the other occurs at 570 and 585 nanometers wavelength in the yellow region. This desired optical filtering is not effectively produced with mixtures containing neodymium oxide itself present simply as a physical pigment possibly due to a refractive index difference existing between air and said pigment. Another problem associated with using neodymium oxide itself as a physical pigment is its tendency to absorb moisture which can lead to serious difficulties after the lamp is manufactured. More particularly, entrapped moisture is prevented from escape within the sealed glass envelope which can lead to a "water cycle" effect such as by attacking the incandescent lamp filament during lamp operation.

Preferred glass frits for use in the present coating contain approximately 40–70 weight percent neodymium oxide dispersed therein while further exhibiting a Coulter particle size in the approximate range 1–3 microns with a surface area in the approximate range 2–5 square meters per gram. An especially preferred glass frit contains in weight percent: 10 ZnO, 11.3 $SiO_2$, 12 $B_2O_3$, 1.3 $Na_2O$, 3.3 $K_2O$, 60 $Nd_2O_3$, and 2.1 F except for residual impurities and refining agents with the comminuted material further exhibiting an apparent density of approximately 0.75 grams per cubic centimeter. As used herein and as is common in glass technology, said glass frit compositions are reported in terms of oxides calculated from the batch starting materials. Although there may be a minor difference between the glass composition as calculated in this conventional manner from batch constituents and any actual glass composition obtained therefrom, both compositions will be essentially the same. There is only slight volatilization of the batch constituents in the present glass frits during melting such as by some loss of fluorine, boric oxide and alkali metal oxides that is to be expected. Consequently, the oxide weight proportions disclosed for said frit glass compositions will closely correspond with values calculated from the starting batch formulation.

DESCRIPTION OF THE PREFERRED EMBODIMENTS

Figure 1:
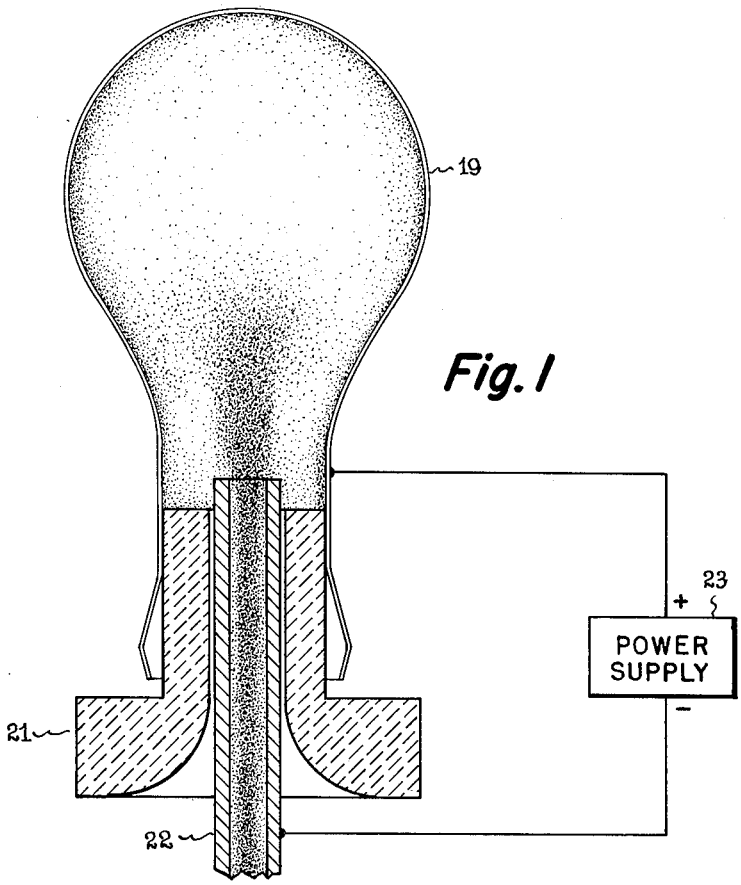
FIG. 1 depicts one method of electrostatically coating the powder mixtures of the present invention.

As depicted in FIG. 1 and as also described more fully in the aforementioned U.S. Pat. No. 4,081,709 patent, the lamp glass bulb 19 while suspended in a suitable holding device such as a chuck 21, is equipped with a supply tube 22 which supplies the powder mixture to the inner surface of the bulb wall. The supply tube 22 conveys a mixture of air and powder from a reservoir (not shown) to the interior of the bulb with the air pressure in the tube being higher than that in the bulb. Bulb 19 is heated to electrical conductance at approximately 160°–170° C., or higher, and a high voltage from supply source 23 is applied between supply tube 22 and the bulb 19. The power supply 23 typically provides an output voltage of 20–35 kilovolts to the charging corona point. It is preferred that supply tube 22 be grounded and the bulb 19 be positive to simplify construction of the coating apparatus. In accordance with said coating method, the above designated especially preferred coating mixture of the present invention was applied by being blown through the supply tube into the bulb picking up a negative charge as it passed the corona point and then being attracted to the positively charged bulb where it was deposited to form the light diffusion coating.

The charging and powder depositing steps in the present coating process are affected by the electrical conductivity of the powder mixture. If the powder is too conductive, it becomes difficult to charge at the corona point and when the powder reaches the bulb, the charge is lost so quickly that the particles of powder are not compacted into an adherent coating, but simply reside on the surface as loose particles. Accordingly, if the powder conductivity exceeds an acceptable range, as hereinafter more fully described, the deposited coating lacks adherence. Powder conductivity below the acceptable range results in different coating problems. The charge on the powder in the coating is retained because of low conductivity and part of the residual charge can thereafter be dissipated by arcing to the glass bulb wall leaving a small pinhole with the powder piled up around it like a crater. These are known as voltage pinholes which can best be seen by lighting the coated lamp. Additionally, the charge built up on the coating with low conductivity powder will repel additional particles of charged powder so that it may prove difficult to achieve a coating thickness sufficient to hide the filament or other internal lamp structure. Applying more powder does increase the coating thickness but produces loose powder deposited on the coating. Weight of deposited coating needed to hide the filament or other internal lamp structure also increases as a result since the coating is now too compacted for effective light scattering.

Figure 2:
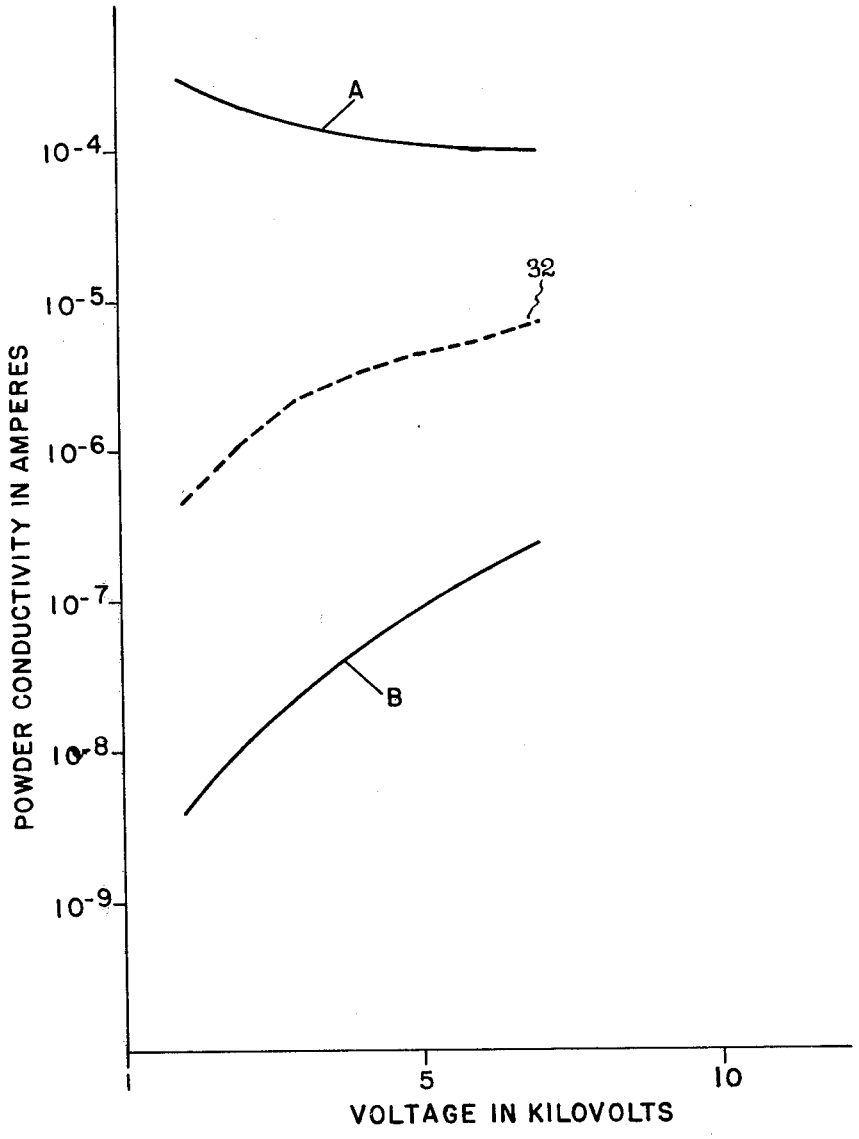
FIG. 2 is a graph illustrating the relationship between electrical conductivity and applied voltage for the powder mixtures of the present invention.

The proper range of electrical conductivity needed in the present powder mixture for electrostatic deposition providing the desired objectives is depicted graphically in FIG. 2. The electrical current which flows through a powder sample is related to the applied voltage across said powder sample as shown in said graph with suitable electrostatic deposition of a particular powder mixture being achieved when the electrical conductivity resides intermediate to curves A and B on said graph. Specifically, suitable electrical conductivity in the powder mixture exists at an applied voltage of 7 kilovolts when the current flow through the powder mixture lies in the range from $1\times10^{-4}$ to $2.3\times10^{-7}$ amperes whereas said current flow range is from $3\times10^{-4}$ to $4\times10^{-9}$ amperes when the applied voltage is 2 kilovolts. Current flow values below curve B on said graph signify too low an electrical conductivity in the powder mixture for suitable results in accordance with the above described method. Likewise, current flows above curve A on the graph signify too high an electrical conductivity in the powder mixture for satisfactory results with said coating process. Intermediate curve 32 on said graph represents the electrical conductivity measured for a powder mixture using a zinc borosilicate glass frit containing approximately 60 weight percent neodymium oxide, 17 parts flux calcined diatomaceous silica, 17 parts fumed silica, and 6 parts colloidal hydrophobic silica.

Figure 3:
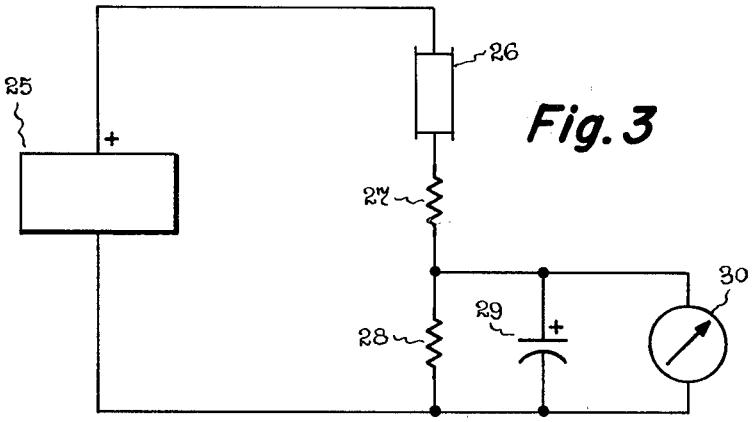
FIG. 3 is an electrical schematic diagram for measurement of electrical conductivity as reported in FIG. 2.

Said electrical conductivity measurements can be carried out with pressed pellets of a powder mixture having a cross sectional area of approximately 0.5 square centimeter and a thickness of about 0.25 centimeter. The pressed samples are prepared wth a 7.5 kilogram loading pressure in the conventional manner. The electrical circuit used to make these conductivity measurements is depicted schematically in FIG. 3. Referring to FIG. 3, a suitable dc power supply 25 applies voltage directly to powder sample 26 across a pair of resistors 27 and 28. The capacitor element 29 and the amperage meter 30 complete the circuit arrangement to permit a direct reading of current flow through the powder sample at a predetermined applied voltage value.

It will be apparent from the foregoing description that an improved electrostatic coating for an incandescent lamp has been provided to produce a selective light absorption in the green and yellow regions of the visible spectrum while still transmitting the remaining visible light for a pleasing aesthetic effect on objects being illuminated by the lamp radiation. It will be apparent to one skilled in the art, however, that still further compositional modifications can be made in the powder mixture other than above specifically disclosed in order to enhance electrostatic deposition. For example, further adjustment of bulk density in the powder mixture can be provided if greater fluidization is desired with a particular coating apparatus by using still other known silica fillers and extenders. It is intended to limit the present invention, therefore, only by the scope of the following claims.

What I claim as new and desire to secure by United States Letters Patent is:

1. An incandescent lamp comprising a sealed glass envelope, a pair of lead-in wires hermetically sealed within said envelope, and a resistive filament connected to said lead-in wires, the improvement which consists of an electrostatically deposited light diffusion coating on the inner surface of said glass envelope sufficient to hide the resistive filament and to absorb light in the green and yellow wavelength region of the spectrum without reducing the light output of said lamp more than approximately 15%, said coating comprising in parts by weight approximately 55–65 parts of a vitreous frit containing neodymium oxide dispersed therein, approximately 10–25 parts flux calcined diatomaceous silica, approximately 10–25 parts fumed silica, and approximately 2–10 parts colloidal hydrophobic silica, all of said silica materials not having a moisture content exceeding about 1 percent by weight.

2. The lamp of claim 1 wherein said light diffusion coating comprises a powder mixture containing 55–65 parts vitreous frit, 14–20 parts flux calcined diatomaceous silica, 14–20 parts fumed silica, and 5–10 parts colloidal hydrophobic silica, said powder mixture having a Coulter particle size between 1 and 6 microns with electrical conductivity in the range from $1\times10^{-4}$ to $2.3\times10^{-7}$ amperes at an applied voltage of 7 kilovolts and $3\times10^{-4}$ to $4\times10^{-9}$ amperes at 2 kilovolts applied voltage.

3. The lamp of claim 1 wherein said vitreous frit is a zinc borosilicate glass containing neodymium oxide.

4. The lamp of claim 3 wherein said vitreous frit contains approximately 40–70 weight percent neodymium oxide.

5. The lamp of claim 1 wherein said vitreous frit comprises in approximate weight percent: 10–20 ZnO, 8–20 $SiO_2$, 15–20 $B_2O_3$, 0–2 $Al_2O_3$, 40–70 $Nd_2O_3$, 1–2 $Na_2O$, 6–8 $K_2O$, 0–5 BaO, 0–5 CaO, 1–3 $ZrO_2$, and 1–3 F except for residual impurities and refining agents.

6. The lamp of claim 3 wherein said vitreous frit exhibits a Coulter particle size in the approximate range 1–3 microns and a surface area in the approximate range 2–5 square meters per gram.

* * * * *